US005347933A

United States Patent [19]

Mathison et al.

[11] Patent Number: 5,347,933

[45] Date of Patent: Sep. 20, 1994

[54] RAILWAY BALLAST CLEANING MACHINE WITH INTEGRATED HOPPER CAR

[75] Inventors: Dennis R. Mathison, Hamel; James H. Perkins, Northfield, both of Minn.

[73] Assignee: Loram Maintenance of Way, Inc., Hamel, Minn.

[21] Appl. No.: 840

[22] Filed: Jan. 5, 1993

[51] Int. Cl.[5] ..... E01B 27/06

[52] U.S. Cl. ..... 104/2; 105/282.2; 105/311.1; 37/104

[58] Field of Search ..... 104/2; 105/282.1, 282.2, 105/311.1; 37/101, 105; 171/16

[56] References Cited

U.S. PATENT DOCUMENTS

| | | | |
|---|---|---|---|
| 3,446,373 | 5/1969 | Keister et al. | 105/311.1 X |
| 3,635,170 | 1/1972 | Chierici | 105/282.1 |
| 3,822,650 | 7/1974 | Fearon | 105/283 X |
| 4,108,076 | 8/1978 | Knape | 104/2 |
| 4,361,096 | 11/1982 | Funk | 105/282.2 X |
| 4,611,541 | 9/1986 | Theurer | 104/2 |
| 4,923,355 | 5/1990 | Mancini | 104/2 X |
| 5,029,649 | 7/1991 | Kershaw et al. | 104/2 X |
| 5,090,484 | 2/1992 | Theurer et al. | 104/2 X |
| 5,094,018 | 3/1992 | Theurer et al. | 104/2 X |
| 5,231,929 | 8/1993 | Theurer et al. | 104/2 |

*Primary Examiner*—Mark T. Le
*Assistant Examiner*—S. Joseph Morano
*Attorney, Agent, or Firm*—Patterson & Keough

[57] ABSTRACT

The disclosed shoulder ballast cleaning machine with integrated hopper car is particularly designed to provide for the temporary conveyance and storage of clean ballast. The shoulder ballast cleaning machine digs up the stone ballast of the railroad bed, separates dirt and debris from the ballast, and replaces the deaned ballast on the railroad bed. The hopper car provides the storage capacity to have ballast on board for deployment on the track bed when the quantity of ballast then being cleaned is inadequate to satisfy the need and to store excess cleaned ballast when the quantity of cleaned ballast exceeds the amount needed to be replaced on the track bed. The hopper car is interposed between the power car and the auxiliary car. A unique conveyor system conveys the fouled ballast from the power car where the ballast is dug up, past the hopper car, to the auxiliary car where the ballast and waste are separated. A further unique conveyor system conveys the cleaned ballast from the separator on the auxiliary car to the hopper car for redeployment on the track bed.

1 Claim, 2 Drawing Sheets

RAILWAY BALLAST CLEANING MACHINE WITH INTEGRATED HOPPER CAR

TECHNICAL FIELD

This invention relates to machines for on-site cleaning of railroad track bed ballast material. More particularly, it relates to an apparatus that integrates a hopper car and a unique ballast handling conveyor system into a ballast cleaning machine for the improved storage and deployment of both new and cleaned ballast material.

BACKGROUND ART

Railroad tracks and cross ties are conventionally supported on beds of stone ballast. The stone ballast provides a firm foundation for the tracks and the cross ties. Further, the spaces between the ballast stones allow for proper drainage of the track bed area. Proper drainage is important to prevent erosion of the track bed area and deterioration of the wooden cross ties, both of which ultimately lead to an unsafe track condition. Over time, the space between the individual stones of the ballast becomes fouled with dirt, debris, and so called "fines" from the wearing down of the individual ballast stones. Fouling of the ballast prevents proper drainage, leading to premature deterioration of the wooden cross ties and weakening of the track bed.

It has become commonplace for railroad companies to periodically remove the ballast from the shoulders of the railroad track beds, clean it, and redispose the cleaned ballast on the shoulders. Such periodic cleaning has been found to restore proper drainage, even when the ballast between the cross ties is not removed and cleaned. The stone ballast is typically removed from the shoulder of the track bed shoulder, carried to a vibrating screen where the stone ballast is separated from the dirt, debris, and fines. The cleaned ballast is then replaced on the bed shoulder. The residual dirt and debris is deposited on either side of the track bed or is stored in a hopper car for removal from the cleaning site.

A problem exists with conventional ballast cleaning machines in that such machines are designed to remove the fouled ballast, clean it, and replace the cleaned ballast onto the track bed immediately as the cleaned ballast emerges from the vibrating screen. At any given time, the ballast that is being redeployed on the track bed is that ballast that was dug up a few minutes prior for cleaning. The quantity of ballast that is redeployed is that ballast that is presently available, without regard to the quantity of ballast that may properly be needed at that particular portion of the track bed.

It is desired, however, that the ballast that is replaced at any given point along the track bed be the correct amount to adequately support the bed and to promote good drainage. The correct amount is not uniform over a given length of track. While it might be assumed that simply removing an amount of ballast, cleaning it and replacing the same amount onto the track bed would be satisfactory, this is frequently not the case. The amount of cleaned ballast available from the cleaning apparatus may be too much or too little for the track bed. Neither condition is presently accommodated by conventional ballast cleaning machines.

The correct amount of ballast is a function of track bed conditions and the operating cycle of the ballast cleaning machine. For instance, when the cleaning operation first commences, there is often not enough cleaned ballast available from the vibrating screen or other cleaning apparatus to put down an adequate quantity of cleaned ballast on the track bed. In this case, supplemental clean ballast is needed. There are also stretches of the track bed that have too little ballast to be removed to be able to lay down an adequate amount of cleaned ballast using only that ballast which has been removed from the track bed and cleaned. In this case also, supplemental clean ballast is needed in order to ensure that an adequate quantity of ballast is returned to the track bed. Conversely, there are stretches of track bed that have an excessive amount of ballast that is removed for cleaning. Only a portion of the removed ballast need be replaced on the track bed in order to have an adequate amount of ballast. Presently, such excess cleaned ballast is wasted by dumping it alongside the track bed. It would be advantageous if the excess portion of the cleaned ballast could be stored on board the ballast cleaning machine for later discharge on the track bed as desired. It would be especially helpful if the excess ballast was available for redeployment along those portions of the track bed where an inadequate amount of fouled ballast is available for removal, cleaning, and redeployment.

The above conditions create a need to have both a ready supply of supplemental ballast for discharge onto the track bed when the supply of freshly cleaned ballast is inadequate and a storage capacity to be able to temporarily store a quantity of excess freshly cleaned ballast that has been removed from the track bed. Conventional ballast cleaning machines do not have the integral storage capacity to convey a sufficient quantity of new ballast to the cleaning site and to have it readily accessible for deploying on the track bed and to store excess ballast as it is cleaned.

Hoppers that function to receive cleaned ballast from the cleaning mechanism and funnel the clean ballast to chutes for immediate redistribution on the track bed shoulder have been used. Examples can be found in U.S. Pat. Nos. 2,775,438, 2,900,745, 3,900,392, and 4,203,493. Such hoppers are utilized as transitory devices that redeploy the cleaned ballast onto the track bed through the chutes attached to the hopper as soon as the ballast is received in the hopper.

A hopper of simple design, integrated with the ballast cleaning machine, that requires a minimum of ballast conveying apparatus and yet has a substantial ballast storage capacity such that ballast is not wasted and is always ready to be distributed along the track shoulder would meet a long felt need in the railroad track maintenance industry.

SUMMARY OF THE INVENTION

A ready ballast holding and distribution system in accordance with the present invention is particularly designed for holding a sufficient quantity of ballast to ensure that the desired amount of ballast is available for distribution on the track bed shoulder at any location along the track and for temporarily storing excess quantities of ballast that are removed from the track shoulder during ballast cleaning operations. The ready ballast holding and distribution system hereof includes a hopper car interposed between the power car that mounts the digger portion and the auxiliary car that mounts the cleaning portion of the ballast cleaning machine. A unique conveyor system is provided to convey the fouled ballast that has been removed from the track shoulder by the digger portion, to the cleaning portion, bypassing the hopper car that is disposed between the digger and cleaning portions of the ballast cleaning machine. An additional conveyor system is provided to convey the cleaned ballast from the cleaning apparatus to the hopper car. The hopper car has chutes for selectively redistributing the ballast onto the track bed shoulder.

DETAILED DESCRIFHON OF THE DRAWINGS

Figure 1A:
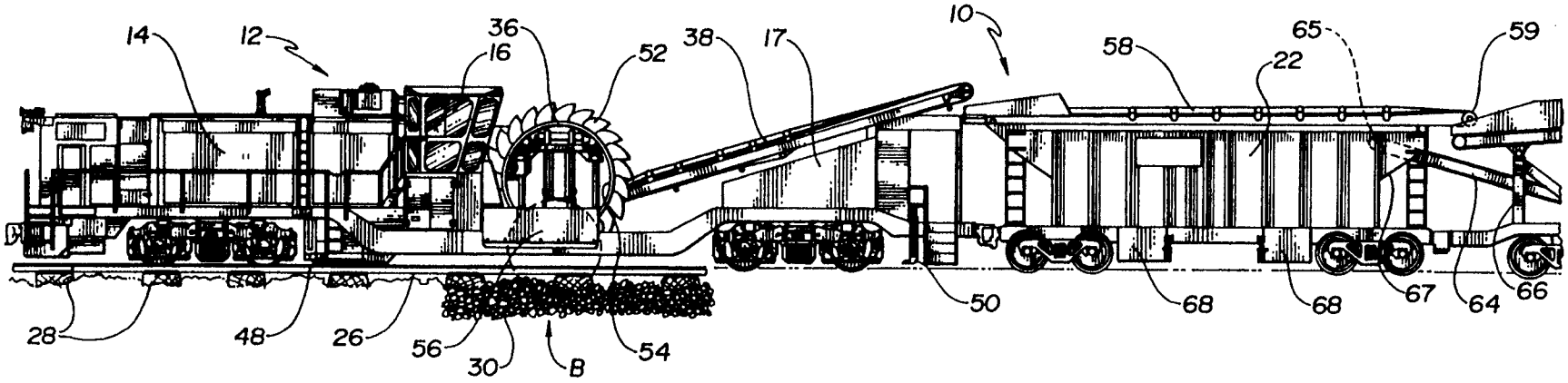
FIGS. 1*a* and 1*b* are a two sheet, left side elevational view of a shoulder ballast cleaning machine with integrated hopper car in accordance with the present invention.

Referring to the drawings, shoulder ballast cleaning machine 10 includes power car 12 having engine compartment 14, forward operator cab 16, and fuel tank 17. Auxiliary car 18 is drawn by power car 12 and includes rear operator cab 20. Hopper car 22 is detachably coupled to the rear of the power car 12 and the front of the auxiliary car 18. Dump car 24 is detachably coupled to the rear of auxiliary car 18. The shoulder ballast cleaning machine is supported by railroad track rails 26 and cross ties 28. The rails 26 and cross ties 30 are supported on a track bed of 30 made up of stone ballast B.

Two major design constraints affect the layout of the ballast cleaning machine 10. The first is that the waste and debris that is separated from the fouled ballast is designed to be disposed of rearward of auxiliary car 18. This is necessary in order to be able to convey the waste material to dump car 24 for later disposal. The requirement to rearwardly dispose of waste material leads to the second constraint in that, because of space limitations affecting ballast cleaning machine 10, the cleaned ballast must then be discharged in the forward direction from auxiliary car 18. A forward discharge necessitates that hopper car 22 be disposed forward of auxiliary car 18 in order to receive the cleaned ballast therefrom. Interposing hopper car 22 between power car 12 and auxiliary car 18 creates a problem of conveying the ballast the has been dug up from power car 12, past hopper car 22, to auxiliary car 18. This required the design of a unique conveyor system to convey the fouled ballast to auxiliary car 18 for cleaning and then to convey the cleaned ballast to hopper car 22 for temporary storage.

The shoulder ballast cleaning machine 10 further includes right and left opposed digger wheels 34,36, lift conveyor 38, screen feed conveyor 40, screen separator 42, waste conveyor 44, and swing conveyor 46. Front and rear scarifiers 48, 50 are positioned on each side of the shoulder ballast cleaning machine 10 for loosening the shoulder ballast making up track bed 30.

Figure 1B:
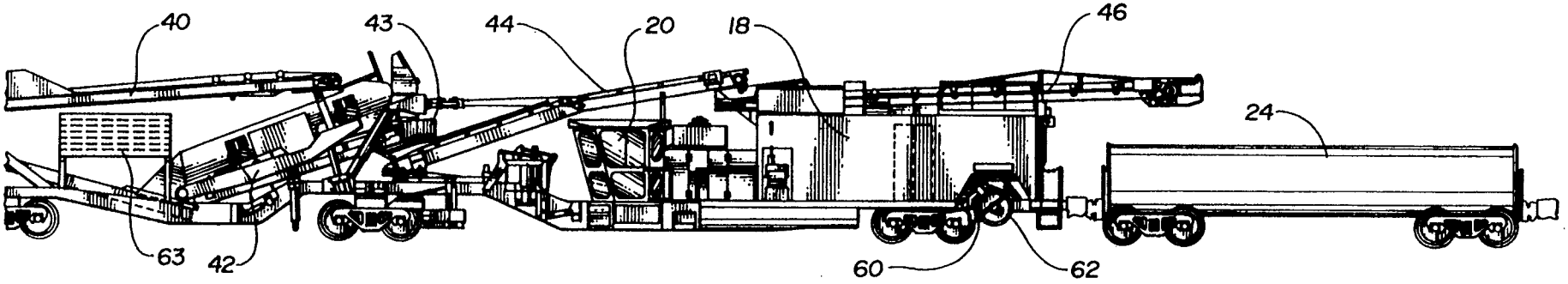
Figure 2A:
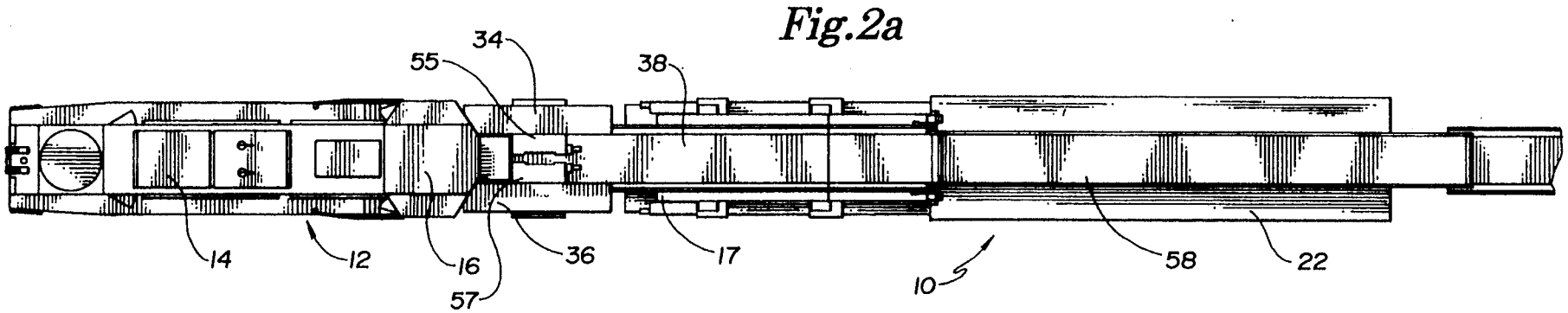
FIGS. 2*a* and 2*b* are a two sheet, top plan view of the shoulder ballast cleaning machine shown in FIGS. 1*a* and 1*b*.
Figure 2B:
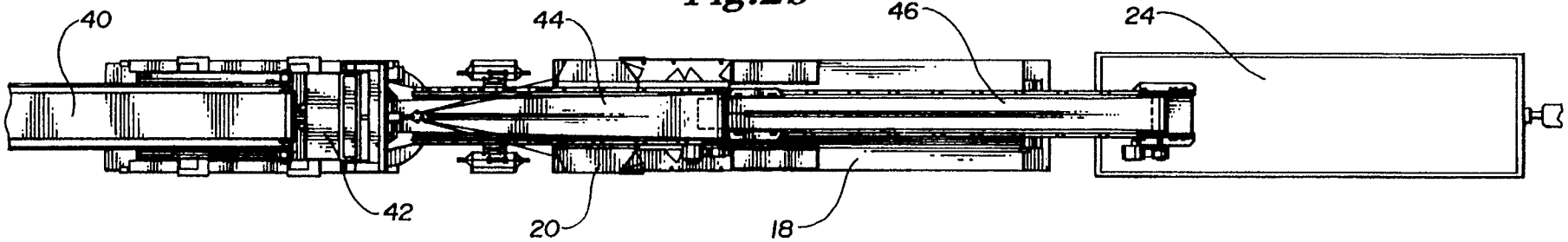

Digger wheels 34, 36 include a plurality of digger buckets 52, mounted on individual rotating support wheels 54. The digger wheels 34, 36 are rotated in a clockwise direction, when viewed from the perspective of FIG. 1*a*, when shoulder ballast cleaning machine 10 is in operation. Shroud 56 covers the lower front and lower sides of the digger wheels 34, 36. The digger wheels 34, 36 are shiftable from the transporting position, as depicted in FIG. 1, to a lowered, operating position, as depicted by phantom lines in FIG. 1. Ballast dug up by the digger wheels 34, 36 is deposited on lift conveyor 38 by means of right and left feeder conveyors 55, 57.

Lift conveyor 38 comprises an endless belt that extends from immediately below right and left digger wheels 34, 36 upwardly and rearwardly, to a point just above the forward end of spanning conveyor 58.

Spanning conveyor 58 is substantially coextensive longitudinally with and overlies the open top of hopper car 22, with extensions at either end of spanning conveyor 58 to receive and discharge fouled ballast respectively. The rear extension of spanning conveyor 58 extends to a point over the forward end of feed conveyor 40 to facilitate the discharge of fouled ballast thereon. Spanning conveyor 58 is permanently affixed to the top of hopper car 22.

Spanning conveyor 58 is powered at its discharge end 59 with either electrical or hydraulical motive means (not shown). When employed, the electrical power is generated by the engine on power car 12. Suitable wiring (not shown) is provided to convey the electrical power from power car 12 to an electric motor (not shown) at discharge end 59. When hydraulic power is utilized, a hydraulic pump (not shown), driven off the engine on power car 12, provides the hydraulic power. Suitable hydraulic plumbing (not shown) is provided from the pump to a hydraulic motor (not shown) positioned at the discharge end 59 to drive the endless belt on spanning conveyor 58.

Feed conveyor 40 directs the discharge of the spanning conveyor 58 rearwardly and downwardly onto the screen separator 42. Feed conveyor 40 is supported in an elevated position by mounts 64 affixed to auxiliary car 18.

Screen separator 42 includes an internal screen (not shown) that extends along the length of the screen separator 42. Waste conveyor 43 includes endless belt that extends along the bottom of the screen separator 42 and discharges into swing conveyor 44 and rearwardly to a point above the dump car loading conveyor 46. The upper, discharge portion of swing conveyor 44 directs the discharge from the swing conveyor 44 downwardly onto the dump car loading conveyor 46.

Swing conveyor 44 is pivotally mounted. The swing conveyor 44 includes an endless belt extending from a point just below the discharge of the waste conveyor 43 rearwardly to the dump car conveyor 46. The swing conveyor 44 may be locked in a center position or positioned either to the right or the left of the shoulder ballast cleaning machine 10 for discharging the waste material clear of the track area. In its center locked position, swing conveyor discharges the waste into the dump car conveyor 46 which conveys the material to the box of dump car 24. Dump car 24 is of standard configuration and is capable of dumping its contents by tipping the box on dump car 24 to the side of the track and opening the side of the box to discharge the contents.

Right and left broom assemblies, left broom assembly 60 being shown, are mounted at the rear of the auxiliary car 18. The broom assemblies each include a rotatable, cylindrical broom 62 shiftable between a raised, stowed position, and a lowered, operating position.

Replacement screens and screens having varying sized mesh are conveniently stored on rack 63. Such screens may be used on screen separator 42 as needed.

Cleaned ballast conveyor 64 accepts the cleaned ballast discharged from the forward (bottom) end of screen separator 42 and lifts the cleaned ballast, depositing it in hopper car 22. To accomplish this, cleaned ballast conveyor 64 is disposed beneath feed conveyor 40 and is supported in this position by the same mounts 66 that support feed conveyor 40. The length of cleaned ballast conveyor 64 is such that its discharge end 65 (shown in phantom in FIG. 1) projects well into hopper car 22, but still has enough lateral clearance so that it is clear of the sides of hopper car 22 on curved sections of track when hopper car 22 and auxiliary car 18 are not aligned longitudinally. Hopper car 22 is modified from the standard hopper car configuration by removing the top portion of the rear wall 67 of hopper car 22 in order to accommodate discharge end 65 of cleaned ballast conveyor 64. An endless belt conveys the cleaned ballast up cleaned ballast conveyor 64 and downward into hopper car 22.

Hopper car 22 is of conventional design such that an existing car of this type may be modified as indicated above and utilized to perform the function of this invention. Hopper car 22 has chute doors 68 in the bottom that selectively expose apertures in hopper car 22 to selectively deploy the mixed new and cleaned ballast onto the track bed. Chute doors 68 have integral chutes. These chutes are capable of directing the discharge of ballast selectively either to the left or the right as desired.

Frequently, when the chute doors 68 are closed while ballast is being discharged, ballast becomes wedged between the chute door 68 and the aperture in hopper car 22. In a preferred embodiment, a portion of the margins of the hopper car gate aperture adjacent to the chute doors are formed of elastic material that has a modules of elasticity that is flexible enough that it prevents ballast stones from jamming the chute door 68 during closing and yet the elastic material is resilient enough to prevent the release of ballast when chute doors 68 are closed. A door employing elastic material disposed on the hopper car aperture margin is the subject of copending application 07/725,025 filed Jul. 3, 1991 and assigned to the assignee of the present invention.

Chute doors 68 may be manually operated or, more desirably, they may be powered by a power drive and actuated by radio control. The power drive may be electric, hydraulic, or pneumatic as desired. In a preferred embodiment, a video camera is utilized to present an image of the trench made by digger wheels 34, 36 to the operator in cab 20. A drive motor is connected to the chute doors 68 to open and close the doors 68. A signal receiver is connected to the drive motor and is capable of selectively providing a command to the drive motor to open and close the chute doors 68. A transmitter is available to the operator in cab 20 enabling the operator to send a command to the receiver to open and close the chute doors 68. The operator is then able to accurately, remotely control the redistribution of cleaned ballast onto the track bed. Remote control actuation of chute doors 68 is the subject of copending application 07/786,332 filed Oct. 31, 1991 and assigned to the assignee of the present invention.

It is important that hopper car 22 maintain its position constant relative to both power car 12 and auxiliary car 18 during the ballast cleaning operations. Such fixed positioning facilitates the transfer of fouled ballast from lift conveyor 38 to spanning conveyor 58 and from spanning conveyor 58 to feed conveyor 40 by ensuring that the discharge end of one conveyor overlies the receiving end of the succeeding conveyor in conveyor system. In order to maintain this relative position constant, slackless drawbars are utilized between power car 12 and hopper car 22 and between hopper car 22 and auxiliary car 18.

In operation, hopper car 22 is partially loaded with new ballast prior to commencing ballast cleaning operations. This preload is utilized for placement on the track bed shortly after commencement of cleaning operations when newly cleaned ballast is not yet available from screen separator 42.

The shoulder ballast cleaning machine 10 is operated in a forward direction, from right to left as depicted in FIG. 1, at a speed of about two miles per hour. The digger wheels 34, 36 are lowered into their digging position, as depicted in phantom lines in FIG. 1, and rotated in a clockwise direction (from the perspective of FIG. 1). The digger wheels are capable of removing fouled ballast from a cut that is as much as 26 inches below the top of the rail and 30 inches wide. The resulting trench must be refilled with clean ballast as the ballast cleaning machine advances. At the commencement of operations, a sufficient quantity of freshly cleaned ballast is frequently not available as yet to fill the resulting trench. In this instance new ballast that has been preloaded in hopper car 22 is dispensed from hopper car 22 until the quantity of freshly cleaned ballast being conveyed to hopper car 22 catches up with the demand for replacement ballast.

In another instance, because of track bed conditions, it may be necessary to remove a substantially greater quantity of fouled ballast from the track bed than is needed for subsequent replacement on the track bed. Rather than waste the deaned ballast that is excess, such as by dumping it alongside the track bed, the excess is stored temporarily in hopper car 22.

In a third instance, track bed conditions may dictate laying down more cleaned ballast than is the output of the screen separator 42 at that time. The ready, mixed new and cleaned ballast that is temporarily stored in hopper car 22 is utilized to satisfy the need for clean ballast for deployment on the track bed until the quantity of cleaned ballast being produced by screen cleaner 42 catches up with demand.

The processing of fouled ballast proceeds as indicated in the following sequence. Stone ballast and debris along the shoulder of the track bed 30 are scooped into the digger buckets 52, and lifted upwardly. When each bucket 52 reaches the top of its respective digger wheel, the stone ballast and debris in the bucket 52 are discharged onto lift conveyor 38 via right and left feeder conveyors 55, 57.

The stone ballast and debris are lifted upwardly and rearwardly by lift conveyor 38, and are discharged from the uppermost end of the lift conveyor 38. Lift conveyor 38 directs the stone and debris downwardly onto spanning conveyor 58. Spanning conveyor 58 conveys the fouled ballast rearward across the open top of hopper car 22 and discharges the fouled ballast onto feed conveyor 40. Feed conveyor 40 continues to convey the fouled ballast rearward and discharges the fouled ballast downward onto screen separator 42.

The screen of the screen separator 42 includes openings in the mesh large enough for dust and debris to fall through the screen, but not large enough to allow the stone ballast to fall through the screen. Vibrating machinery is attached to the screen separator 42 so that the stone ballast and debris are vigorously shaken on the screen surface. The debris falls thought he screen onto the waste conveyor 43 and the stone ballast falls downwardly and forwardly. The clean stone ballast is discharged onto the cleaned ballast conveyor 64 located at the forward end (bottom) of the screen separator 42. The cleaned stone ballast is then transported upwardly and is discharged into hopper car 22.

In the preferred embodiment, the operator in cab 20 monitors the need for replacement ballast on the track bed through a video camera mounted to view the trenches dug by the digger wheels 34, 36. The operator is able to selectively open chute doors 68 and redeploy the cleaned ballast as needed. Chute doors may be opened to either side, thereby permitting the discharge to both the right and left sides of track 30 or to either side as desired. The opening size of chute doors 68 can be modulated to permit the discharge of varying amounts of ballast as warranted by track bed conditions.

The debris deposited on the waste conveyor 43 by the screen separator 42 is transported rearwardly and upwardly by the waste conveyor into swing conveyor 44. The waste and debris discharged from the swing conveyor 44 is directed downwardly onto dump car loading conveyor 46. In its center locked position, swing conveyor 44 discharges the waste and debris rearwardly into dump car loading conveyor 46 which discharges the waste into dump car 24. Alternatively, the swing conveyor 44 may be swung to the right or the left of the shoulder ballast cleaning machine 10, and the waste and debris is discharged from the swing conveyor 44 well to the side, clear of the railroad track bed 30.

As the shoulder ballast cleaning machine advances along the track performing the ballast cleaning operations, the rails 26 and cross ties 28 are swept clear of loose stone ballast by the right and left broom assemblies 60.

What is claimed is:

1. A ready ballast holding and distribution system for a railway shoulder ballast cleaning machine having a first digger portion including a plurality of digger buckets for scooping up fouled ballast having dirt and debris imbedded therein from along a railway shoulder and depositing said fouled ballast within said machine and a second cleaning portion including ballast cleaning means operably positioned to receive said fouled ballast for separating said debris from said fouled ballast to provide cleaned ballast and separated debris, said ready ballast holding and distribution system comprising:

a hopper car having rail engaging wheels interposed between and operably coupled to the first portion of the ballast cleaning machine and the second portion of the ballast cleaning machine for selectively retaining a quantity of clean ballast ready for selective distribution on the track shoulder and having a plurality of downwardly directed chute doors adapted for deployment of clean ballast along the railway shoulders, said chute doors being selectively variably openable for controlling the quantity of ballast being deployed and being selectively positionable to deploy ballast on either railway shoulder;

first conveyor means for transporting fouled ballast from the digger portion to the cleaner portion and having a span terminating in a first end and an opposed second end, the first end operably positioned adjacent to the digger portion for receiving fouled ballast therefrom and the second end operably positioned adjacent to the cleaning portion for delivering fouled ballast thereto, the span of the first conveyor means being generally coextensive longitudinally with and overlying said hopper car;

second conveyor means for conveying the cleaned ballast from the cleaning means to the hopper car and having a first end and an opposed second end, the first end being disposed to receive cleaned ballast from the ballast cleaning means and the second end being disposed to discharge the cleaned ballast into the hopper car.

* * * * *

UNITED STATES PATENT AND TRADEMARK OFFICE

CERTIFICATE OF CORRECTION

PATENT NO. : 5,347,933

DATED : September 20, 1994

INVENTOR(S) : Dennis R. Mathison et al.

It is certified that error appears in the above-identified patent and that said Letters Patent is hereby corrected as shown below:

In the Abstract, line 6, delete the word "deaned" and substitute therefor --cleaned--.

Column 6, line 33, delete the word "deaned" and substitute therefor --cleaned--.

Column 6, line 68, delete the words "thought he" and substitute therefor --through the--.

Signed and Sealed this

Twenty-eight Day of February, 1995

*Attest:*

Bruce Lehman

BRUCE LEHMAN

*Attesting Officer*

*Commissioner of Patents and Trademarks*